United States Patent [19]

Hess et al.

[11] 4,338,747

[45] Jul. 13, 1982

[54] LIFTING MECHANISM FOR A MOTORCAR WINDOW

[75] Inventors: Peter Hess, Coburg; Hans Rampel, Eicha, both of Fed. Rep. of Germany

[73] Assignee: Metallwerk Max Brose GmbH and Company, Coburg, Fed. Rep. of Germany

[21] Appl. No.: 87,305

[22] Filed: Oct. 22, 1979

Related U.S. Application Data

[63] Continuation of Ser. No. 849,668, Nov. 8, 1977, abandoned.

[30] Foreign Application Priority Data

Nov. 15, 1976 [DE] Fed. Rep. of Germany ..... 2652076

[51] Int. Cl.[3] ..... E05F 15/08

[52] U.S. Cl. ..... 49/349; 74/526; 74/89.15

[58] Field of Search ..... 49/349; 74/89.14, 89, 74/89.15, 526

[56] References Cited

U.S. PATENT DOCUMENTS

| | | | |
|---|---|---|---|
| 2,595,580 | 5/1952 | Hill | 49/349 X |
| 2,905,003 | 9/1959 | Meyer et al. | 74/89.14 |
| 3,247,732 | 4/1966 | Barnhart | 74/89 |
| 3,757,472 | 9/1973 | Rogakos | 49/349 X |

*Primary Examiner*—Kenneth Downey

*Attorney, Agent, or Firm*—Toren, McGeady & Stanger

[57] ABSTRACT

The window in the door of a motorcar may be raised and lowered by means of a lifting mechanism including an electric motor connected to a speed reducing, worm gear transmission and a lifting arm turned by the output shaft of the transmission through further speed-reducing gears. The stroke of the window movement is limited by cooperating fixed, but adjustable abutments on supporting structure and an abutment connected to the output shaft of the worm gear transmission for joint rotation.

7 Claims, 21 Drawing Figures

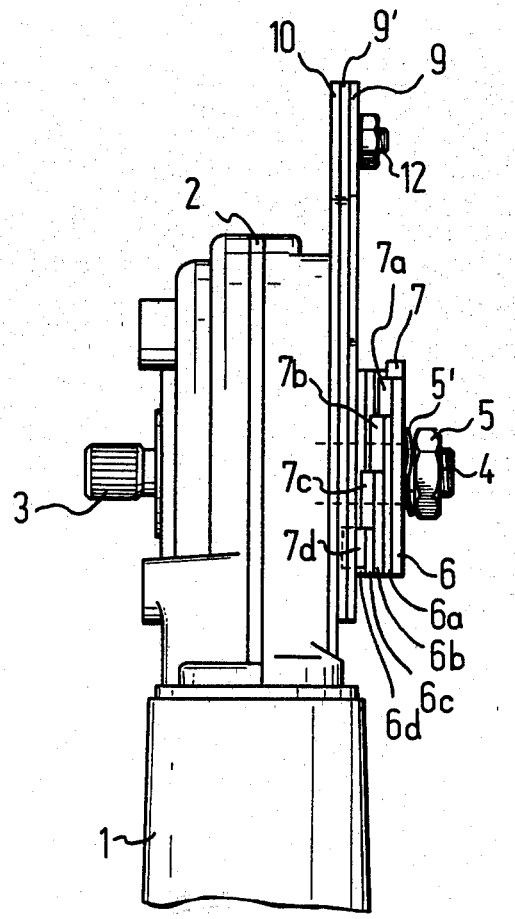
Fig. 2
Fig. 3
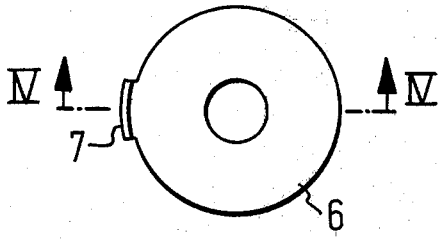
Fig. 4
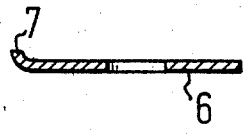

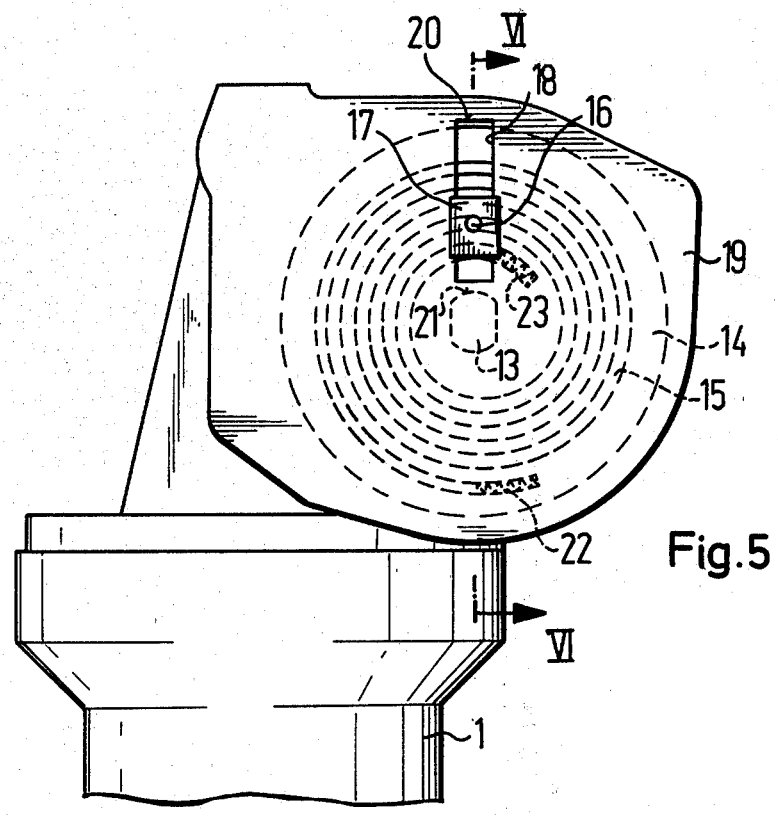
Fig.5
Fig.6
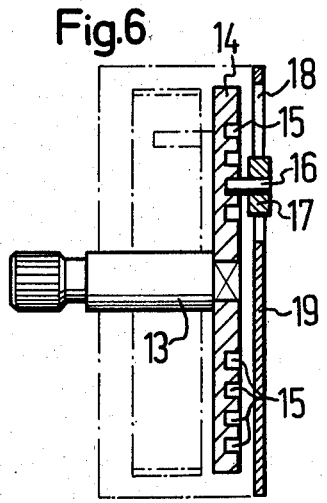
Fig.7
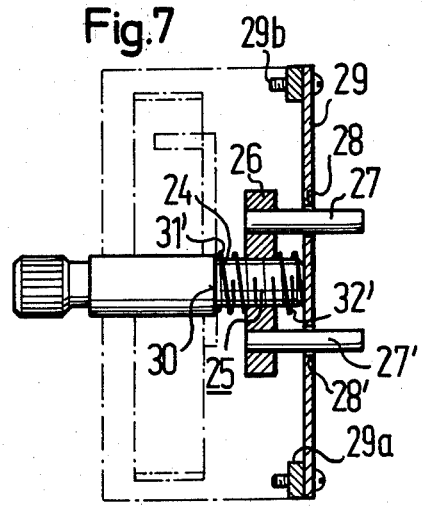

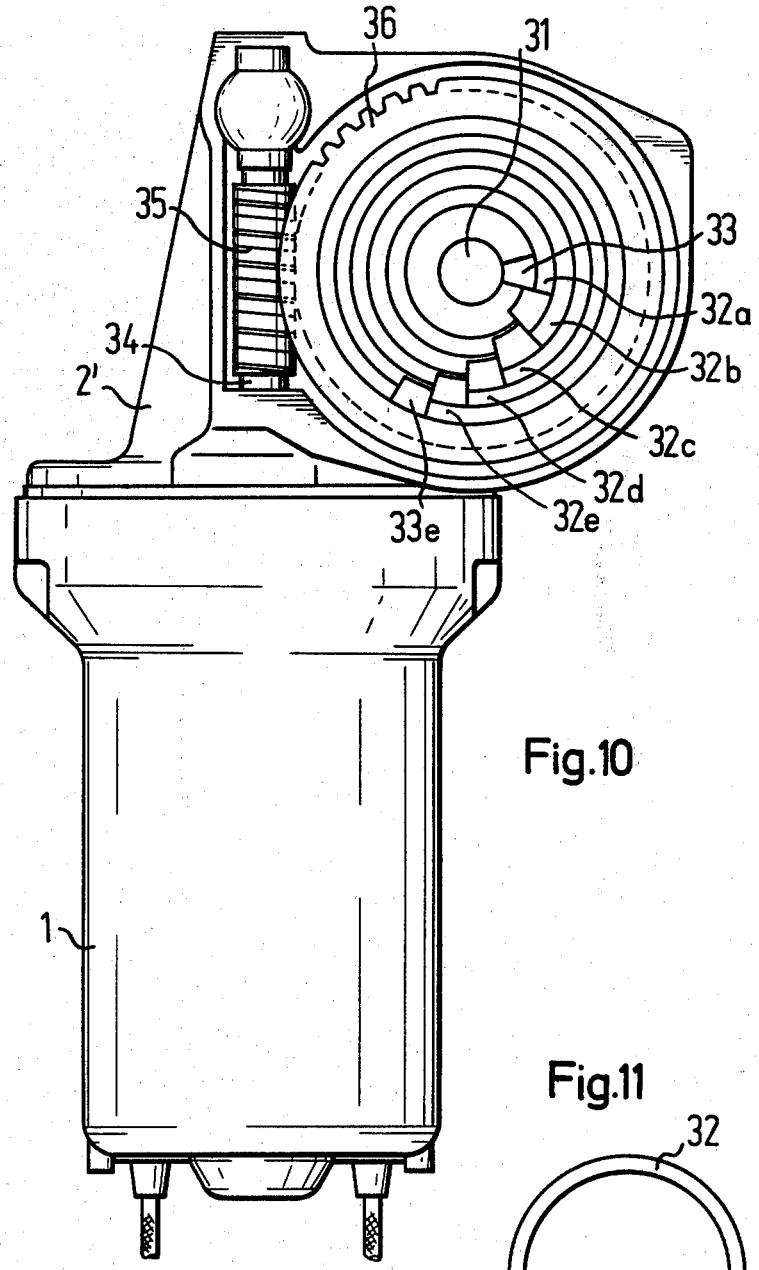
Fig.10
Fig.11
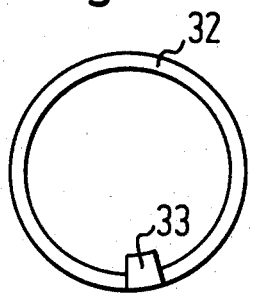
Fig.12
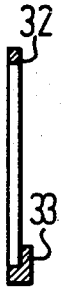

Fig.13
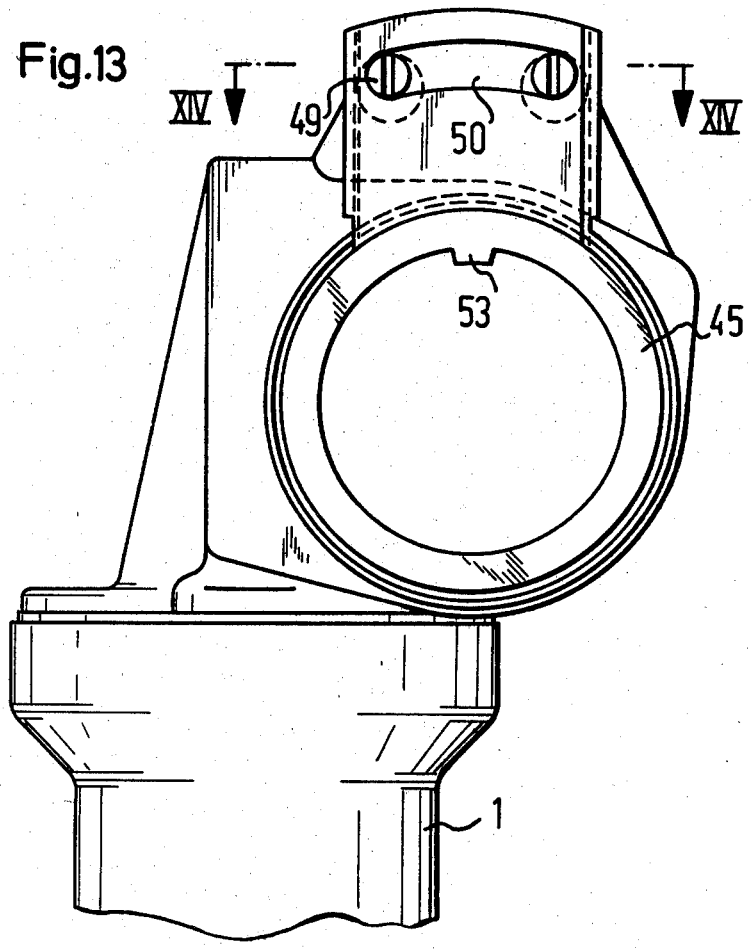
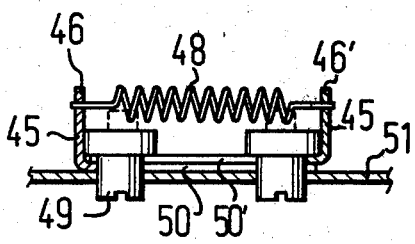
Fig. 14
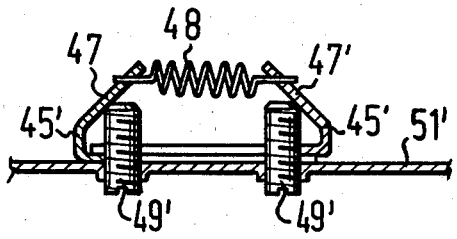
Fig. 15

Fig.16
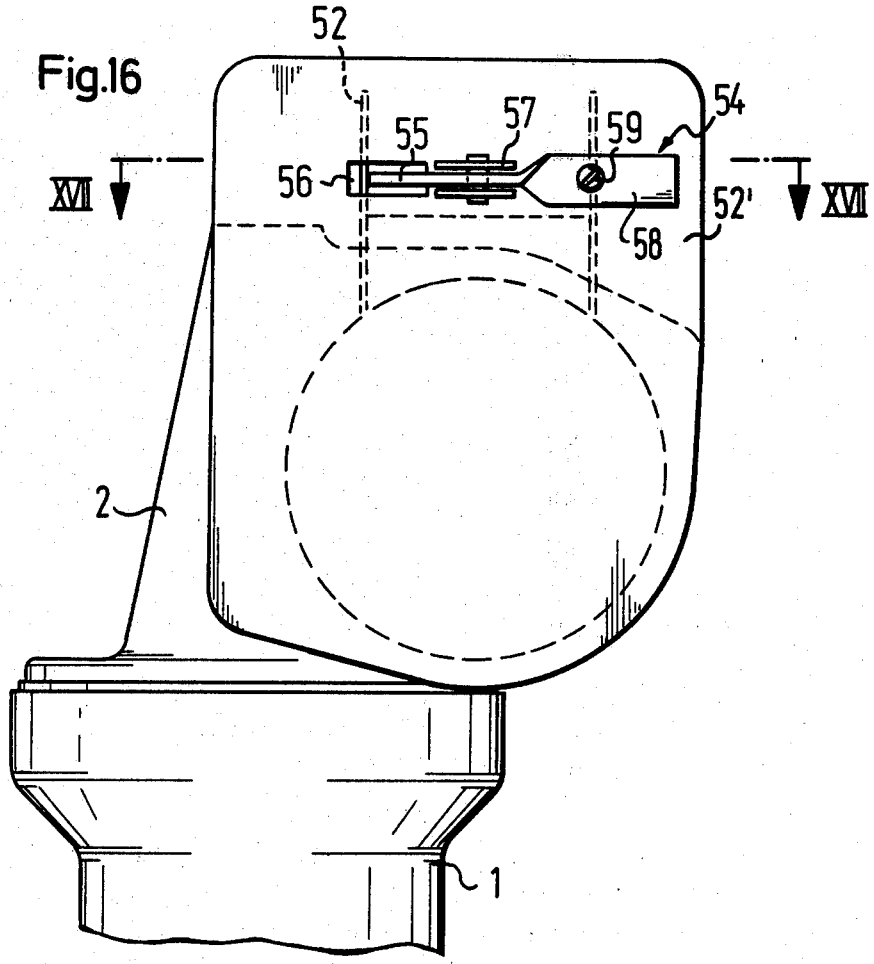
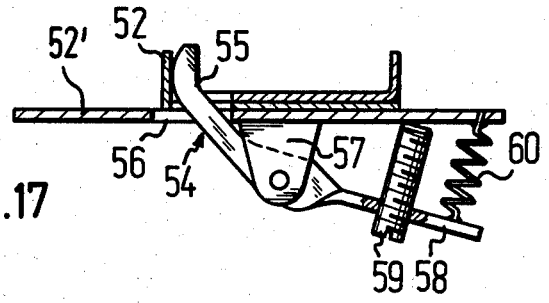
Fig.17

LIFTING MECHANISM FOR A MOTORCAR WINDOW

This is a Continuation of Application Ser. No. 849,668 filed Nov. 8, 1977 now abandoned.

This invention relates to a lifting mechanism for a window, and particularly to a lifting mechanism for a window in a motorcar door or the like which is equipped with an improved electric drive unit.

It is known from the published German patent application No. 1,708,164 to limit the lifting path of a motor driven window by means of fixed abutments on the supporting structure which cooperate with a movable abutment coupled to the output shaft of a speed reducing transmission driven by an electric motor. If the upper and/or lower limit of window travel needs to be adjusted to compensate for manufacturing tolerances or for other reasons, the known window lifting mechanism must be disassembled at least in part, and structural elements must be replaced.

It is the primary object of this invention to provide a window lifting arrangement permitting the path of the lifted window to be adjusted in a simple manner as to the lowermost and/or highermost positions of the window.

With this object and others in view, the invention provides a window lifting arrangement in which an electric motor is mounted on a support and coupled to a speed reducing transmission. A motion transmitting train, which may include further speed reducing elements, drivingly connects the output shaft of the transmission to the window to be lifted. A movable abutment is operatively connected to the output shaft for movement therewith, and fastening means fasten a fixed abutment to the support in each of a plurality of positions of engagement spaced in the direction of movement of the movable abutment for engagement by the latter, and for thereby limiting the window movement.

Other features, additional objects, and many of the attendant advantages of this invention will readily be appreciated as the same becomes better understood by reference to the following detailed description of preferred embodiments when considered in connection with the appended drawing in which:

FIG. 2 illustrates the unit of FIG. 1 in side elevation;

FIG. 3 is a front-elevational view of an element of the unit of FIG. 1;

FIG. 4 shows the element of FIG. 3 in section on the line IV—IV;

FIG. 5 illustrates another drive unit in fragmentary rear elevation;

FIG. 6 shows elements of the unit of FIG. 5 in section on the line VI—VI;

FIG. 7 illustrates elements of a modified drive unit in the manner of FIG. 6;

FIG. 10 shows the unit of FIG. 8 without the rear wall of its casing to reveal internal structure;

FIG. 11 illustrates an element of the unit of FIG. 10 in a corresponding view;

FIG. 12 is a side-elevational, sectional view of the element of FIG. 11;

FIG. 13 shows yet another drive unit of the invention in a view corresponding to that of FIG. 1;

FIG. 14 shows elements of the unit of FIG. 14 in section on the line XIV—XIV;

FIG. 15 illustrates a modification of the device of FIG. 14 in a corresponding view;

FIG. 16 is a fragmentary rear elevation of an additional drive unit of the invention;

FIG. 17 shows a portion of the unit of FIG. 16 in section on the line XVII—XVII;

Figure 21:
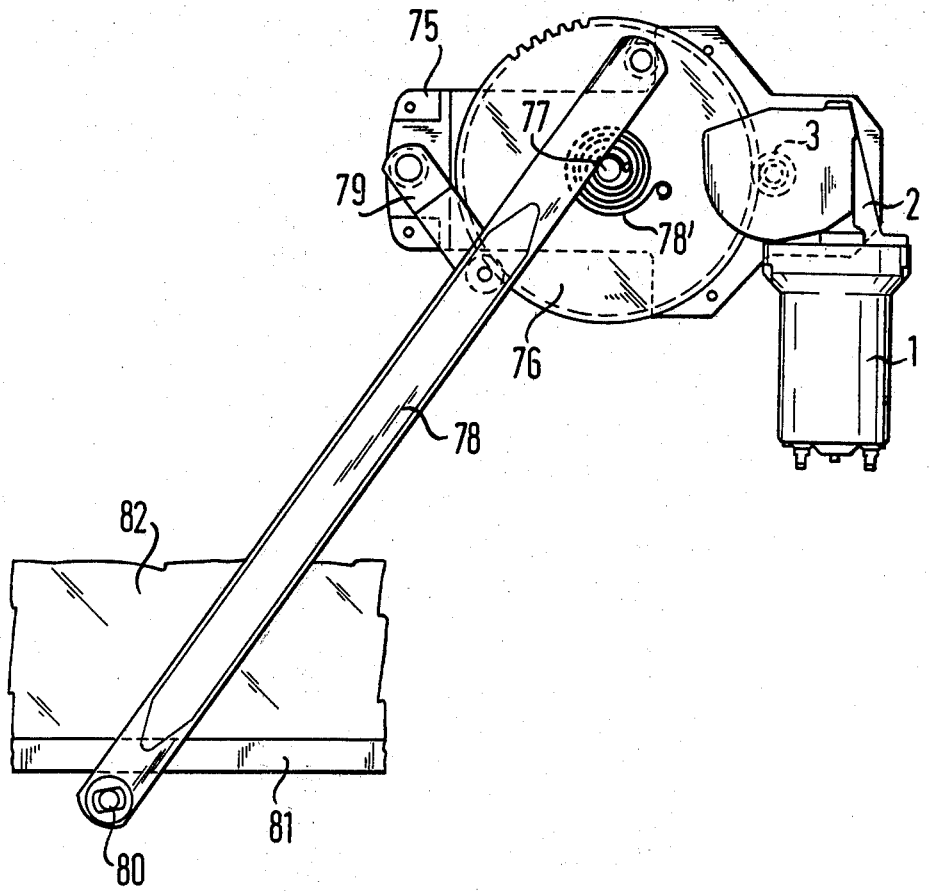
FIG. 21 is a front elevation, on a smaller scale, of a window lifting mechanism including one of the drive units of FIGS. 1 to 19.

Referring now to the drawing in detail, and initially to FIG. 21, there is shown only as much of a basically conventional window lifting mechanism in the door of a motorcar as is needed for an understanding of the invention. The supporting structure of the mechanism includes a bracket 75 normally fastened between the upright facings of a car door. A large toothed wheel 76 rotatably mounted on the bracket 75 by means of a stub shaft 77 is biased clockwise by a spiral spring 78'. One end of a straight, motion-transmitting arm 78 is pivoted to the wheel 76 near the toothed rim, and is further connected to the bracket 75 by a hinged link 79. A pin 80 at the other end of the arm 78 slidably supports a channel 81 along the lower edge of a window 82 which is vertically guided in the door frame in a manner conventional in itself and not shown, and whose weight is partly balanced by the spring 78'.

The wheel 76 is driven by a sprocket 3 on the output shaft of a speed reducing, worm-gear transmission 2 on a reversible electric motor 1. This invention is more particularly concerned with the drive unit including the motor 1, the transmission 2, and associated elements mounted on the bracket 75. Several embodiments of this invention which will be described hereinbelow differ from each other mainly in the drive units, and the other parts of the lifting mechanisms associated with the drive units may all be as shown in FIG. 21.

Referring initially to FIGS. 1 to 4, the shaft 4 which carries the sprocket 3 also projects rearwardly from the transmission housing in which it is axially secured by a nut 5. A disc 6 is coaxially fastened on the shaft 4. An abutment lug 7 projects radially outward and axially from the circumference of the otherwise circular disc 6, as is best seen in FIGS. 3 and 4. Four additional discs **6*a*, 6*b*, 6*c*, and 6*d* are rotatably supported on the shaft 4, but otherwise similar to the disc 6 and carry respective lugs 7*a*, 7*b*, 7*c*, 7*d*. The lug 7*d* of the disc 6*d* axially engages a circularly arcuate slot 8 in a sheet-metal abutment plate 9 and a corresponding slot in a plate 9' identical with the plate 9 and receiving the shaft 4 in an oversized bore centered in the arc of the slots 8. The stack of discs 6–6*d* and plates 9, 9' is axially compressed between the nut 5 and a sheet metal plate 10 and is fixed on the casing of the transmission 2 by a spring washer 5'. The angular positions of the plates 9, 9' on the shaft 4 may be varied as far as permitted by a bolt 12 passing from the plate 10 through identical, circularly arcuate slots 11 in the plates 9, 9' much farther from the axis of the shaft 4 than the slots 8**.

The arcuate length of each slot 8 is approximately 320°, that of each slot 11 slightly less than 30°. In the condition of the drive unit illustrated in FIGS. 1 and 2, the circumferential ends of the slots 8 and those of the slots 11 are axially aligned.

Figure 1:
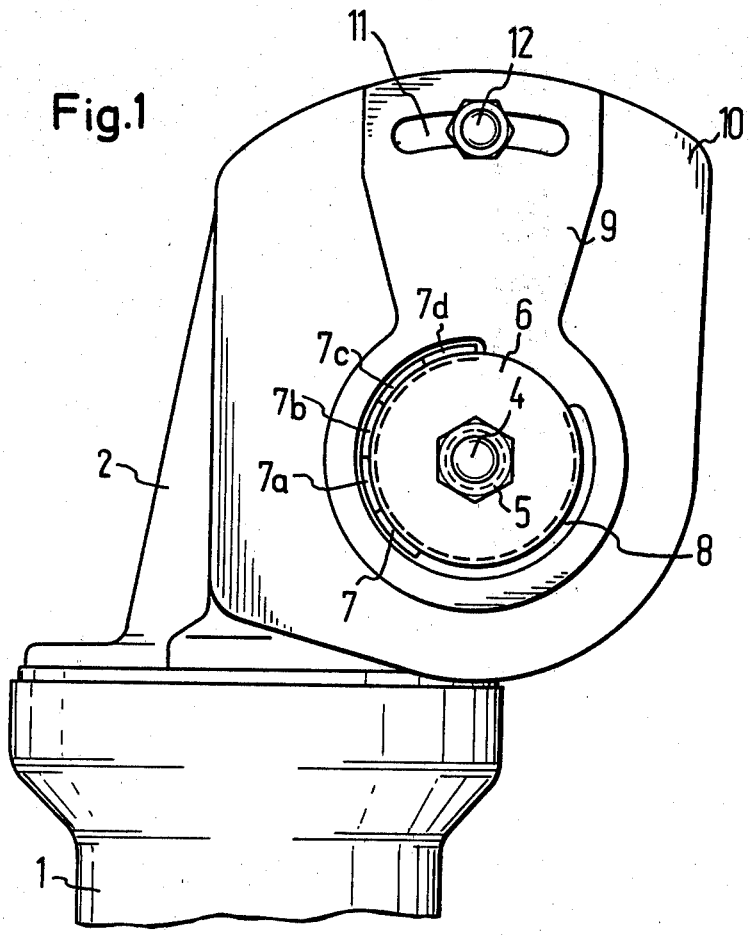
FIG. 1 shows a drive unit for a window lifting mechanism of the invention in fragmentary rear elevation.
Figure 8:
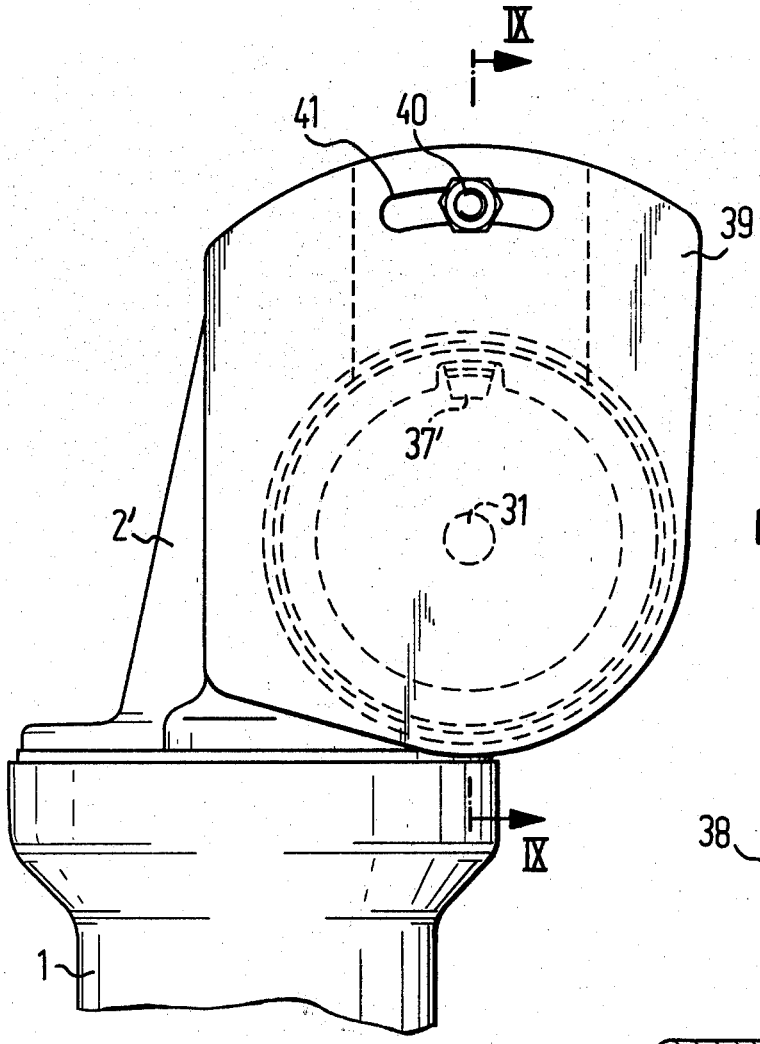
FIG. 8 is a fragmentary, rear-elevational view of yet another drive unit of the invention.
Figure 9:
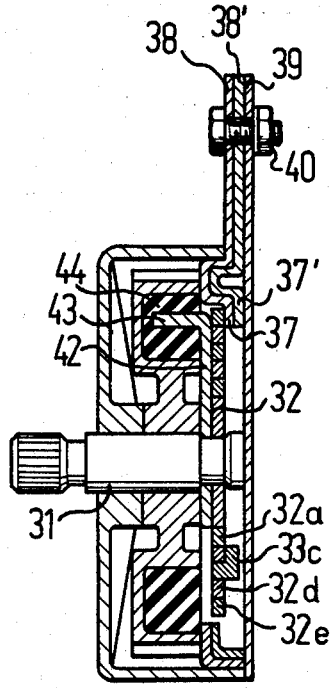
FIG. 9 shows a portion of the unit of FIG. 8 in section on the line IX—IX.

When the motor 1 is energized to raise the window 82, the shaft 4 turns counterclockwise, as viewed in FIG. 1, and the lug 7 moves with the disc 6 almost one full turn before it abuts against the lug 7*a*, the lug 7*b* being axially out of range of the lug 7. Thereafter, the disc 6*a* turns with the shaft 4 and the disc 6 until, after almost another full turn of the shaft 4, the lug 7*a* engages the lug 7*b*. During further rotation of the shaft 4, the discs 6*b*, 6*c*, 6*d* are sequentially taken along. The lug 7*d* ultimately is moved from its illustrated position in one pair of aligned ends of the slots 8 to the other pair of ends. Further movement of the disc 6*d* is prevented thereby. The shaft 4 is stopped, and the resulting rise of the current flowing through the motor 1 triggers an overload relay, not shown, but conventional in electric motor circuits, which disconnects the motor from its source of energy. When the motor thereafter is energized to lower the window, the shaft 4 can turn until the lugs 7–7*d* are returned to the position illustrated in FIG. 1, and is switched off thereafter.

The transmission ratios of the worm gear transmission 2 and of the further speed reducing transmission constituted by the sprocket 3 and the wheel 76 are coordinated with the circumferential widths of the several lugs 7–7*d* in such a manner that the window is moved between the fully closed and the fully open condition during the operation of the motor 1 permitted by the drive unit in the condition shown in FIG. 1 if the path of the window is as long as manufacturing tolerances for the window frame, the window itself, and other elements of the car may permit. If the window travel is near its nominal length, or below that within permissible tolerance limits, the motor 1 must be stopped earlier.

The end of current supply to the motor can be set very precisely by shortening the effective, common length of the two slots 8. The clamping nut on the bolt 12 is loosened, and the plates 9, 9' are shifted on the shaft 4 relative to each other as needed. The lug 7*d* is axially long enough to extend into the slots 8 of both plates 9, 9'. It may be stopped in one direction by the end of the slot in the plate 9, and in the other direction by the end of the slot in the plate 9'. If the path of window travel is of satisfactory length, but needs to be shifted up or down in its entirety, the two plates 9, 9' are turned jointly on the shaft 4.

In the modified drive unit seen in FIGS. 5 and 6, the output shaft 13 of the worm gear turns a circular plate 14. A spiral groove 15 in an exposed radial face of the plate 14 is engaged by a pin 16 axially projecting from a slide 17. The slide is guided in a slot 18 of a fixed plate 19 along a radius of the plate 14. Helical compression springs 22, 23 respectively received in the outer and inner ends of the groove 15 are compressed by the pin 16 when the window 82 approaches respective ends of its path. Ultimately, the wire turns of the engaged spring touch each other, making further compression of the spring impossible and stopping the motor 1.

The number of available turns of the motor 1 and the location of the window path may be varied in the apparatus of FIGS. 5 and 6 by installing the springs 22, 23 at the two ends 20, 21 of the slot 18 instead of the groove 15. Furthermore, travel of the window 82 may be adjusted by replacing the plate 19 by another, otherwise identical plate having a shorter or longer slot 18 and/or by replacing the plate 14 by another one having a longer or shorter groove 15 than is shown in the drawing. Springs 22, 23 may optionally be installed in the modified groove or slot.

In the drive unit partly illustrated in FIG. 7, the output shaft of the worm gear transmission has a reduced end 25 provided with threads 24 on which an internally threaded disc 26 is mounted. Two diametrically opposite, axial pins 27, 27' on the disc 26 are guided in bores 28, 28' of a cover plate 29 of the transmission casing. A helical compression spring 31' is interposed on the shaft end 25 between the disc 26 and a shoulder 30 of the shaft, and another, similar spring 32' between the disc 26 and the plate 29. The plate is mounted on brackets 29*a* of the transmission casing by means of screws 29*b*.

The path of the window 82 raised and lowered by rotation of the transmission shaft may be lengthened, shortened, or shifted by correspondingly changing the available threaded movement of the disc 26. Shims may be interposed between the brackets 29*a* and the plate 29 to retard the moment when the turns of the spring 32 abut against each other to stop the motor 1. The springs 31', 32' may be replaced by other springs capable of being compressed to a greater or smaller axial length, and the springs 31', 32' may be dispensed with altogether so that the motor 1 is stopped after the disc 26 itself engages the plate 29 and the shoulder 30. Ultimately, the shaft may be replaced by one otherwise identical, but having a reduced, threaded end longer or shorter than the end 25.

The drive unit shown in FIGS. 8 to 12 includes a worm gear transmission 2' mainly consisting of a worm 35 fixedly fastened on the output shaft 34 of the motor 1 and meshing with a worm wheel 36 which is rotatably mounted on the output shaft 31 of the transmission. A coupling ring 44 of synthetic rubber is fixedly mounted in a radially open groove of the worm wheel. A radial arm 42 is fixedly fastened to the output shaft 31. Its free end 43 is offset into an axial direction and embedded in the ring 44.

An abutment ring 32 is fixedly fastened to the arm 42 and the shaft 31, and is enveloped by six additional concentric rings 32*a*–32*e*. A lug 33 on the ring 32 projects axially out of the common plane of the rings 32–32*e* and radially inward to overlap the ring 32*a*. Similar lugs project from the other rings so that each ring is axially secured between the arm 42 and a lug of an adjacent ring, as is shown with reference to the ring 32*b* and the lug 33*c* in FIG. 9. The lug 33*e* on the outermost ring 32*e* travels in a circularly arcuate path when engaged by the lug on the ring 32*d* during rotation of the shaft 31 in the manner described in more detail with reference to FIGS. 1 to 4.

Two abutment plates 38, 38' of partly annular configuration are axially secured between the casing of the transmission 2' and a fixed cover plate 39 of the transmission casing. Respective portions of the abutment plates 38, 38' project radially from the annular portions which are free to move angularly about the axis of the shaft 31. Abutments 37, 37' project radially inward from the plates 38, 38' into the path of the lug 33*e*. A clamping screw 40 passes through axially aligned, identical, arcuate slots 41 in the plates 38, 38' and the cover 39 to secure the plates 38, 38' to the supporting structure of the drive unit in a fixed position in which the two abutments 37, 37′ are axially aligned to permit travel of the lug 33*e* through the longest possible, unobstructed path. When the screw 40 is loosened, the abutments 37, 37′ may be moved apart and fixed in other angular relationships to the cover 39 to shorten the stroke of the ring 32*e*, and thus of the window 82, or to shift both abutments 37, 37′ in unison in the manner described above with reference to FIGS. 1 to 4.

FIGS. 13 and 14 show a drive unit identical with the unit of FIGS. 8–12, as far as not explicitly shown and described otherwise. It differs from the unit described in the preceding paragraphs by two abutment plates 45 whose annular portions are identical with those of the plates 38, 38′. The radially projecting portions carry respective lateral flanges 46, 46′ in planes parallel to each other and to the axis of the transmission shaft. Two pins 49 are rotatably received in respective bores of a cover plate 51 fixed on the transmission casing and omitted from the showing of FIG. 13. The pins pass through respective slots 50, 50′ in the abutment plates 45 which are circularly arcuate about the axis of the transmission shaft, not itself seen in FIGS. 13 and 14, and their ends carry eccentric radial cams. The flanges 46, 46′ are connected by a helical tension spring 48 which holds the flanges 45 in engagement with the cams on the pins 49. The path of the window 82 connected to the partly illustrated drive unit may thus be adjusted precisely by turning the pins 49.

In the modified unit partly illustrated in FIG. 15, and identical with the unit of FIGS. 13 and 14, as far as not illustrated, the radially projecting portions of the abutment plates 45′ are provided with sheet metal flanges 45′ which are inclined obliquely relative to the axes of two set screws 49′ threadedly mounted in the cover plate 51′ of the transmission casing. A helical tension spring 48 biases the flanges 47, 47′ into camming engagement by the screws 49′ so that the angular position of each plate 45′ relative to the supporting structure may be modified by turning the associated screw 49′, and the modified position is fixed by the spring 48.

In the drive unit shown in FIGS. 16 and 17 which is identical with or closely similar to that of FIGS. 13–15, as far as not explicitly shown and described otherwise, the radially projecting portions of two abutment plates carry respective, parallel, lateral flanges 52. The associated cover plate 52′ is provided with an opening 56 adjacent the flange 52 of one abutment plate. A two-armed lever 54 is fulcrumed on the cover plate 52′ by means of a bearing bracket 57. One of its arms passes through the opening 56 and aligned openings in the two abutment plates and carries a cam 55 on its free end which engages the adjacent flange 52 of one abutment plate. The other arm 58 is biased toward the cover plate 52′, that is, counterclockwise as viewed in FIG. 17, by a helical tension spring 60. Movement of the lever under the biasing force of the spring 60 is stopped by a set screw 59 on the lever arm 58. The position of the abutment plate engaged by the lever 54 may thus be changed by turning the set screw 59.

In the illustrated embodiment, the other abutment plate is fixedly attached to the cover plate 52′, and a tension spring, not shown, but identical in structure and function with the spring 48 in FIGS. 14 and 15 holds the cam 55 engaged with the movable abutment plate. If so desired, the other abutment plate may also be mounted on the transmission casing for angular movement about the axis of the transmission output shaft, and provided with another lever arrangement identical with that shown in FIG. 17 for adjustment of its position relative to the cover plate 52′ and/or the abutment plate illustrated to be similarly movable.

Figure 18:
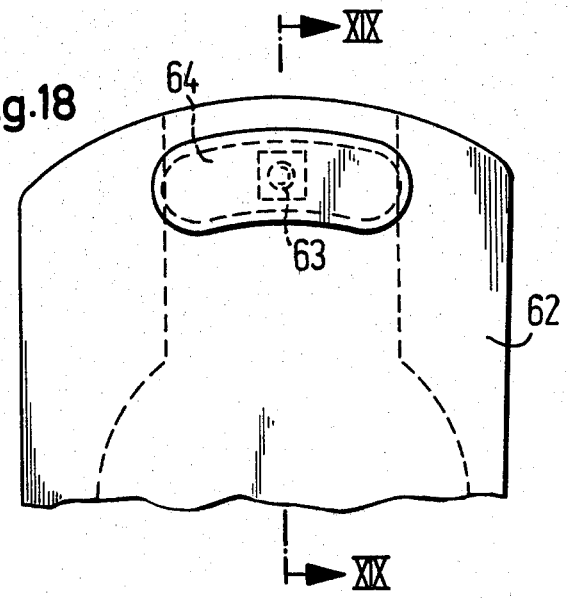
FIG. 18 is a rear-elevational, fragmentary view of a further drive unit of the invention.
Figure 19:
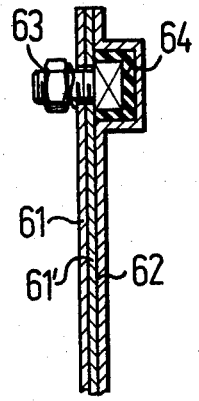
FIG. 19 shows the device of FIG. 18 in section on the line XIX—XIX.

FIGS. 18 and 19 illustrate a partial modification of the otherwise unchanged drive unit shown in FIGS. 8 to 12. The clamping screw 63 is mounted on the cover plate 62 in a rubber cushion 64 whose resiliency limits circumferential displacement of the screw 63 during abutting engagement of a lug with a fixed abutment on one of the abutment plates 61, 61′ and thus supplements the cushioning action of the rubber ring 44. If so desired, the ring 44 may be omitted when the structure of FIGS. 18 and 19 is employed.

Each of the drive units described with reference to FIGS. 1 to 19 may be supplemented in the manner shown in FIG. 20. A wall 65 of the motorcar door, not otherwise shown, provides a mounting base on which the transmission casing and other supporting structure of the drive unit is mounted by three screws 69. The shaft 4 of the worm gear transmission passes movably through the wall 65 as a locating pin. The screws 69 pass through respective slots 68 in the wall 65 which are circularly arcuate about the axis of the shaft 4. When the screws 69 are loosened, the entire drive unit may be turned about the shaft axis within limits set by locating pins 66, 66′ on the transmission casing and received in circularly arcuate slots 67, 67′ of the wall 65.

Figure 20:
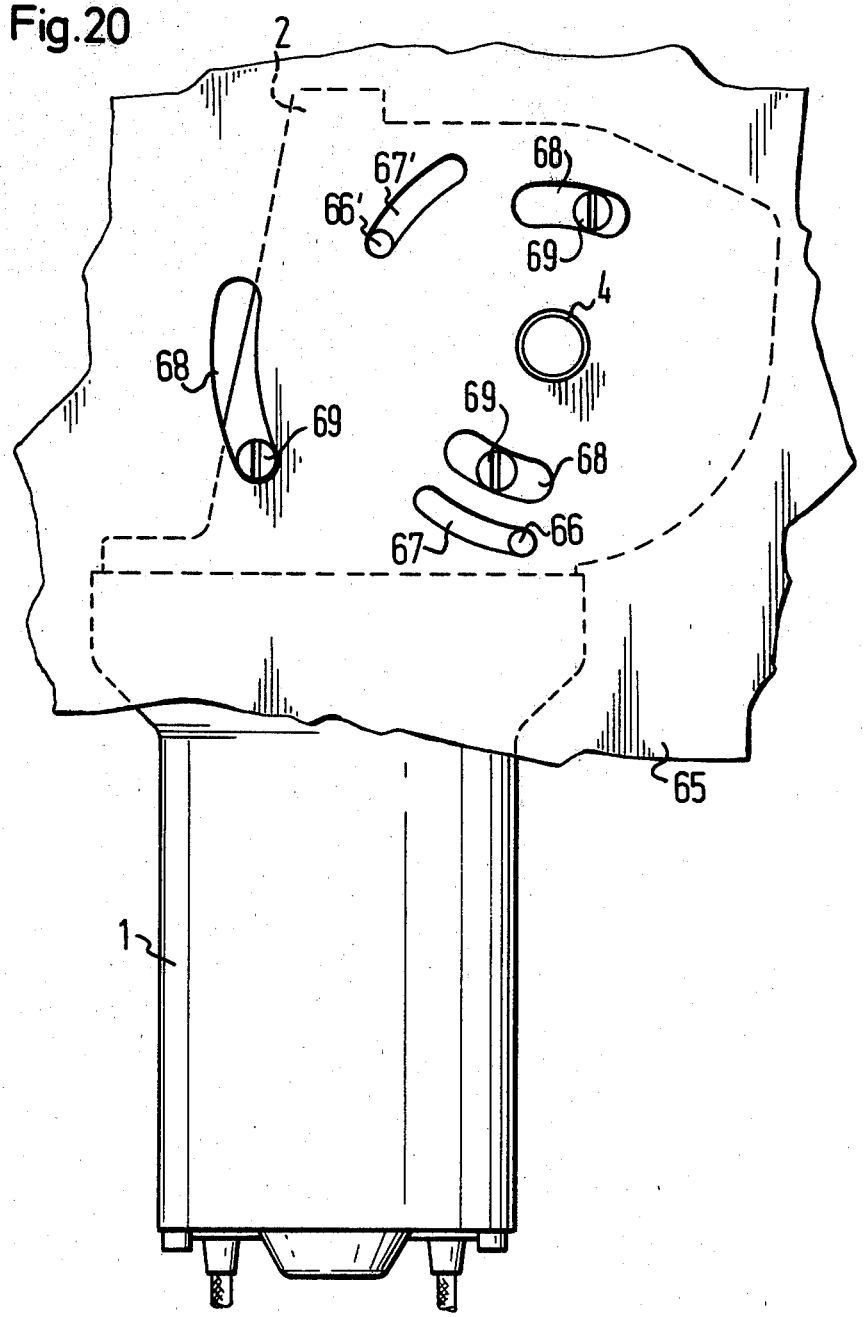
FIG. 20 illustrates yet another drive unit of the invention in elevation together with partly illustrated supporting structure.

In combination with the abutment arrangements permitting the individual setting of upper and lower limits for the stroke of the associated window 82, the device shown in FIG. 20 permits the entire path of the window to be shifted upward or downward without change in length and in a particularly simple and convenient manner.

It should be understood, of course, that the foregoing disclosure relates only to preferred embodiments of the invention, and that it is intended to cover all changes and modifications of the examples herein chosen for the purpose of the disclosure which do not depart from the spirit and scope of the invention set forth in the appended claims.

What is claimed is:

1. In a window drive mechanism including a window mounted for guided movement through a fixed path, drive means including a rotating output shaft, transmission means coupled to transmit a driving force from said drive means to said window, and limit means for limiting the rotative range of said output shaft in order to limit the driven range of said window, the improvement wherein said limit means comprise: stop means including a first and a second abutment spaced apart a predetermined distance; a driven member attached in driving engagement with said output shaft; means operatively associated with said driven member for bringing said driven member into motion-limiting engagement with said first abutment when said output shaft rotates in a first direction and into motion-limiting engagement with said second abutment when said output shaft rotates in a second direction opposite to said first direction; said driven member, said operatively associated means and said stop means being arranged such that said output shaft must rotate through a rotative range greater than 360° in order for said driven member to be brought from motion-limiting engagement with one of said first and said second abutments into motion-limiting engagement with the other of said first and said second abutments; said stop means comprising a pair of plates both mounted for adjustable rotative movement about a common axis, each of said plates having formed therein an arcuate slot formed to coincide with the circumference of a circle having said common axis as its center, said slots being located to extend in overlapping juxtaposition with one end of one of said slots being adapted to define said first fixed abutment and with the opposed end of the other of said slots being adapted to define said second fixed abutment, said pair of plates being rotatively adjustable relative to each other to enable adjustment of the relative distance between said first and said second abutments thereby to effect adjustment of the rotative range of said output shaft, said operatively associated means including a part in driven engagement with said driven member and extending into both said slots for abutting engagement, respectively, with said first and said second fixed abutments.

2. A mechanism according to claim 1 wherein said driven member is mounted to be rotated together with said shaft and includes a first abutment member affixed thereto and wherein said operatively associated means comprise at least one freely rotatable member having a second abutment member affixed thereto, said first and said second abutment members being arranged to be brought into driving engagement with each other in both rotative directions of said output shaft to effect driving engagement between said driven member and said freely rotatable member; said second abutment member being arranged to be moved between abuting engagement with said first and second fixed abutments to limit the rotative range of said output shaft as a result of the driving engagement between said driven and said freely rotatable member; with the sum of the angular range of motion of said first and said second abutment members required to bring said second abutment member from abuting engagement with one of said first and said second fixed abutments into abuting engagement with the other of said first and said second fixed abutments being greater than 360°.

3. A mechanism according to claim 2 wherein said operatively associated means comprise a plurality of freely rotatable members each having an abutment member affixed thereto with the abutment members of each of said freely rotatable members being arranged to be brought into driving engagement with said first abutment member in consecutive order, said second abutment member of said at least one freely rotatable member being brought into driving engagement with said first abutment member last through the driving engagement of each of the other abutment members.

4. In a window drive mechanism including a window mounted for guided movement through a fixed path, drive means including a rotating output shaft, transmission means coupled to transmit a driving force from said drive means to said window, and limit means for limiting the rotative range of said output shaft in order to limit the driven range of said window, the improvement wherein said limit means comprise: stop means including a first and a second abutment spaced apart a predetermined distance; a driven member attached in driving engagement with said output shaft; means operatively associated with said driven member for bringing said driven member into motion-limiting engagement with said first abutment when said output shaft rotates in a first direction and into motion-limiting engagement with said second abutment when said output shaft rotates in a second direction opposite to said first direction; said driven member, said operatively associated means and said stop means being arranged such that said output shaft must rotate through a rotative range greater than 360° in order for said driven member to be brought from motion-limiting engagement with one of said first and said second abutments into motion-limiting engagement with the other of said first and second abutments; and means for adjusting the position of said first and said second abutments relative to each other to enable adjustment of the rotative range of said ouput shaft.

5. A mechanism according to claim 4 wherein said driven member comprises a disc mounted to rotate with said output shaft and having a spiral groove formed therein; wherein said operatively associated means comprise a slide member mounted for linear movement within an elongated slot and a pin fixed to said slide member and extending into driving engagement within said spiral groove; and wherein said first and said second fixed abutments comprise opposite end walls of said elongated slot.

6. A mechanism according to claim 4 wherein said driven member comprises an internally threaded member arranged in threaded driving engagement with said output shaft and including means for restricting movement thereof to linear movement axially of said drive shaft; wherein said first and said second fixed abutments comprise a pair of walls fixedly spaced apart axially of said output shaft; and wherein said operatively associated means comprise parts of said driven member located to be brought into abutting engagement, respectively, with said pair of walls.

7. A mechanism according to claim 1 or 4 wherein said stop means comprise an elongated slot; wherein said first and said second fixed abutments comprise the ends of said slot; and wherein said operatively associated means comprise a part in driven engagement with said driven member and extending to within said slot for abuting engagement, respectively, with said ends of said slot.

* * * * *